US011148857B2

(12) United States Patent
de Sicart et al.

(10) Patent No.: US 11,148,857 B2
(45) Date of Patent: Oct. 19, 2021

(54) GLASSWARE LID AND GLASSWARE WITH SAME

(71) Applicant: GENICOOK PRODUCT LLC, Garland, TX (US)

(72) Inventors: David Prieto de Sicart, Garland, TX (US); Marc Zamora Salvador, Garland, TX (US); Jianzhong Zhang, Garland, TX (US); Xiaojia Liu, Garland, TX (US)

( * ) Notice: Subject to any disclaimer, the term of this patent is extended or adjusted under 35 U.S.C. 154(b) by 0 days.

(21) Appl. No.: 16/867,592

(22) Filed: May 6, 2020

(65) Prior Publication Data

US 2020/0262619 A1 Aug. 20, 2020

(51) Int. Cl.
*B65D 43/12* (2006.01)
*B65D 51/16* (2006.01)

(52) U.S. Cl.
CPC ..... *B65D 43/12* (2013.01); *B65D 51/1683* (2013.01)

(58) Field of Classification Search
CPC ..... B65D 43/12; B65D 51/1683; B65D 45/16
USPC ..... 220/367.1, 231, 316, 324
See application file for complete search history.

(56) References Cited

U.S. PATENT DOCUMENTS

| | | | | |
|---|---|---|---|---|
| 5,317,959 | A * | 6/1994 | Beluzzi | A47J 27/09 99/337 |
| 6,779,681 | B2 * | 8/2004 | Doerfler | A45C 13/12 206/1.5 |
| 6,789,692 | B2 * | 9/2004 | Prezelin | B65D 45/20 190/119 |
| 2004/0232026 | A1 * | 11/2004 | Goeking | A47J 36/027 206/459.1 |
| 2013/0098921 | A1 * | 4/2013 | Yang | A47J 27/0811 220/573.1 |
| 2015/0053695 | A1 * | 2/2015 | Kim | A47J 36/10 220/573.1 |
| 2015/0136786 | A1 * | 5/2015 | Lonner | B65D 21/086 220/529 |
| 2016/0332785 | A1 * | 11/2016 | Sexton | B65B 7/2842 |
| 2017/0303661 | A1 * | 10/2017 | Salciarini | B65D 43/0231 |
| 2018/0265263 | A1 * | 9/2018 | Li | B65D 53/02 |
| 2020/0140149 | A1 * | 5/2020 | Ragias | B65D 45/20 |

* cited by examiner

*Primary Examiner* — J. Gregory Pickett
*Assistant Examiner* — Niki M Eloshway

(57) ABSTRACT

The present invention relates to and provides a glassware lid and a glassware with same. After food is heated, the lid is covered; a first end of the air hole sliding lid is turned so that the air hole is communicated with outside atmosphere to avoid forming a vacuum state inside; when the lid needs to be taken out, the first sliding parts and the second sliding parts continue to slide to separate the hoop from the glassware body, which is convenient to operate. The structure is compact and the arrangement is reasonable.

12 Claims, 6 Drawing Sheets

GLASSWARE LID AND GLASSWARE WITH SAME

TECHNICAL FIELD

The present invention relates to the technical field of glassware, and more particularly to a glassware lid and a glassware with same.

BACKGROUND

The glassware lid generally does not have air holes. After food in the glassware is heated, the food is taken out and the lid is covered. When the food is cooled, a vacuum state is formed inside. The existing glassware lid is not easy to open. In an opening process, a sealing silica gel ring even falls off. Therefore, how to provide a glassware lid that is convenient to open is a problem to be urgently solved by those skilled in the art.

SUMMARY

For this reason, one purpose of the present invention is to propose a glassware lid which is convenient to open.

The present invention provides a glassware lid which comprises:

a lid body, wherein a through slot is arranged at the edge of the lid body; both sides of the through slot are respectively provided with two groups of first sliding parts; a platform is formed in the through slot; and the platform is provided with a first bracket and a vent hole in sequence from outside to inside;

a shaft rod, wherein the shaft rod is hinged on the first bracket;

and an air hole sliding lid, wherein the bottom of one end of the air hole sliding lid is hinged on both ends of the shaft rod, and a part of the air hole sliding lid corresponding to the vent hole can be turned to change a flow state or cutoff state of the vent hole and an external airflow; both sides of the other end corresponding to the two groups of first sliding parts are provided with two groups of second sliding parts, and the end part of the other end is provided with a hook for clamping a glassware body.

It is known from the above technical solution that compared with the prior art, the present invention discloses and provides a glassware lid. After food is heated, the lid body is covered; a first end of the air hole sliding lid is turned so that the air hole is communicated with outside atmosphere to avoid forming a vacuum state inside; when the lid needs to be taken out, the first sliding parts and the second sliding parts continue to slide to separate the hoop from the lid body; and the glassware lid is easily taken out, which is convenient to operate. The hoop of the lid of the present invention is combined with the air hole lid, so that a product structure is compacter and arrangement is more reasonable.

Further, the lid body comprises a top lid, a middle lid and a bottom lid which are connected in sequence; the area of the middle lid is larger than the area of the top lid and the area of the bottom lid, and the through slot is arranged at the edge of the middle lid; a hemispherical recess is formed on the top lid near the vent hole. This design can reduce the weight of the lid body, and at the same time, the bottom lid is matched with an inner wall of the glassware body for better sealing performance. The platform extends to the top lid, to provide an operating space for turning one end of the air hole sliding lid.

Further, the shaft rod comprises a first straight rod section, a bending section and a second straight rod section; both ends of the first straight rod section are bent upward to form the bending section, and the bending section is connected with the second straight rod section; the second straight rod section is arranged in parallel to the first straight rod section; the first straight rod section is hinged on the first bracket; and the bottom of one end of the air hole sliding lid is hinged on the second straight rod section.

Further, the air hole sliding lid comprises a turning lid, a sliding lid and a connecting plate; the bottom of the turning lid is provided with a second bracket, and the second straight rod section is hinged on the second bracket; two side surfaces of the sliding lid are provided with the second sliding parts, and the end part is bent downward to form the hook; the connecting plate is connected between the turning lid and the sliding lid, and the plane of the connecting plate and the plane of the sliding lid form $\alpha$ angle; and the material hardness of a side near the sliding lid is less than the material hardness value of the other side. Thus, the turning lid is conveniently turned.

A curved through slot is formed in the middle of the hoop of the sliding lid, which is convenient for finger operation to pushing out the hoop. Because an arc is formed at the edges of the lid body and the glassware body, this design is beneficial to reduce a connection error between the hook and the glassware body and reduce the problem of uneven contact points between the middle of the hook and the glassware body.

Further, the $\alpha$ angle is 120°-150°. The vent hole protrudes from the height of the platform and is higher than the height of the bracket, which is convenient for the turning lid to cover the vent hole. The angle setting is beneficial for connecting the connecting plate to the turning lid and the sliding lid which are not in the same plane.

Further, the bottom of the turning lid near the second bracket is provided with a plug; and the plug protrudes downward, and corresponds to the position of the vent hole. This is more beneficial to seal the interior of the glassware when not heating.

Further, the first sliding parts are sliding rails or chutes; and the second sliding parts are chutes or sliding rails corresponding to the first sliding parts.

Another purpose of the present invention is to provide a glassware which comprises a glassware body, a sealing element and the above glassware lid; the glassware body is provided with a connecting edge corresponding to the position of the through slot; the hook is clamped on the connecting edge; the first sliding parts and the second sliding parts are in sliding fit; the sealing element is installed on the bottom of the lid body for sealing a gap between the glassware body and the lid body. The sealing element can be a sealing ring and is sleeved on the bottom lid.

In the normal state of the present invention, the vent hole is closed, and the turning lid and the sliding lid are in a parallel state. During heating, the turning lid is turned at the hemispherical recess, and the turning lid drives the shaft rod to rotate so that the shaft rod is tilted upward, i.e., the turning lid is separated from the vent hole. The vent hole is communicated with the outside. Because the hoop and the connecting edge are matched and the first sliding parts and the second sliding parts are not matched, the seal between the lid body and the glassware body is not affected. When the lid body needs to be opened, the sliding lid is pushed outwards to enable the shaft rod to continue to rotate backwards; the first sliding parts and the second sliding parts slide relatively, until the hook and the connecting edge are separated, to take out a dish body. In this process, the reason that the first sliding parts and the second sliding parts are not separated is that the shaft rod is hinged with the second bracket, and the matching length of the first sliding parts and the second sliding parts is larger than the matching length of the hook and the connecting edge.

In the present invention, according to the sealing area on the lid body, more than two groups of air hole sliding lids can be arranged, and the materials and shapes of the lids are not limited as long as the needs of use ca be satisfied. Moreover, the above designs of the present invention shall be included within the protection scope of the present invention. The glassware in the present invention may be a glass crisper, a high borosilicate glass baking tray, and the like, but not limited to the above types of glassware.

DESCRIPTION OF DRAWINGS

To more clearly describe the technical solution in the embodiments of the present invention or in the prior art, the drawings required to be used in the description of the embodiments or the prior art will be simply presented below. Apparently, the drawings in the following description are merely the embodiments of the present invention, and for those ordinary skilled in the art, other drawings can also be obtained according to the provided drawings without contributing creative labor.

Figure 1:
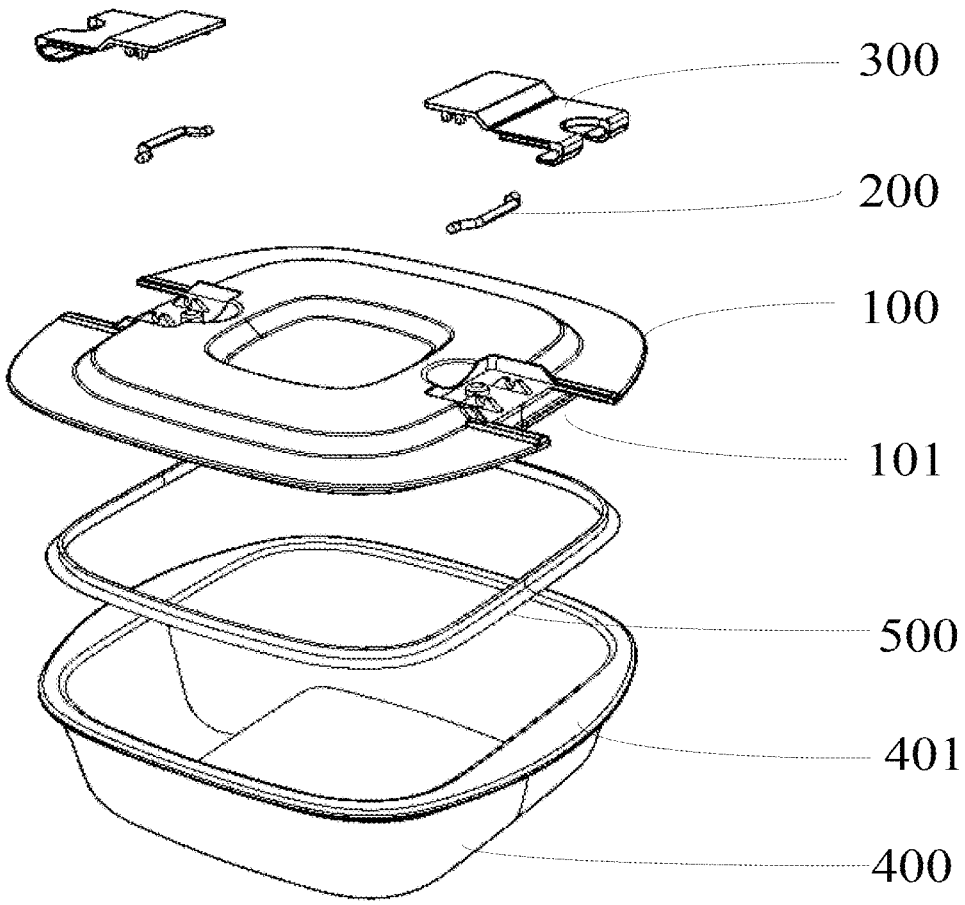
FIG. 1 is an explosive view of a glassware provided by the present invention.

In the figures: 100-lid body; 101-through slot; 102-first sliding part; 103-platform; 104-first bracket; 105-vent hole; 106-recess; 200-shaft rod; 201-first straight rod section; 202-bending section; 203-second straight rod section; 300-air hole sliding lid; 301-plug; 302-second sliding part; 303-hoop; 304-turning lid; 305-sliding lid; 306-connecting plate; 307-second bracket; 400-glassware body; 401-connecting edge; and 500-sealing element.

DETAILED DESCRIPTION

Embodiments of the present invention will be described below in detail. Examples of the embodiments are shown in drawings, wherein same or similar reference signs refer to same or similar elements or elements having same or similar functions from beginning to end. Embodiments described below by reference to the drawings are exemplary embodiments, and are used for explaining the present invention, and shall not be understood as a limitation to the present invention.

It should be understood in the description of the present invention that terms such as "upper", "lower", "front", "rear", "left", "right", "vertical", "horizontal", "top", "bottom", "inner", "outer", etc indicate direction or position relationships shown based on the drawings, and are only intended to facilitate the description of the present invention and the simplification of the description rather than to indicate or imply that the indicated device or element must have a specific direction or constructed and operated in a specific direction, and therefore, shall not be understood as a limitation to the present invention.

In addition, the terms such as "first" and "second" are only used for the purpose of description, rather than being understood to indicate or imply relative importance or hint the number of indicated technical features Thus, the feature limited by "first" and "second" can explicitly or impliedly comprise one or more features. In the explanation of the present invention, the meaning of "a plurality of" is two or more unless otherwise clearly specified.

In the present invention, unless otherwise specifically regulated and defined, terms such as "installation", "connected", "connecting", "fixation" and the like shall be understood in broad sense, and for example, may refer to fixed connection or detachable connection or integral connection, may refer to mechanical connection or electrical connection, and may refer to direct connection or indirect connection through an intermediate medium or inner communication of two elements or interaction relationship of two elements. For those ordinary skilled in the art, the specific meanings of the above terms in the present invention may be understood according to concrete conditions.

In the present invention, unless otherwise clearly specified and defined, a first feature is "above" or "below" a second feature comprises that the first feature and the second feature come into direct contact or the first feature and the second feature come into contact through additional features thereof instead of direct contact. Moreover, the first feature is "on", "above" and "over" the second feature comprises that the first feature is directly above or slightly above the second feature, or just indicates that the horizontal height of the first feature is higher than that of the second feature. The first feature is "under", "below" and "beneath" the second feature comprises that the first feature is directly below or slightly below the second feature, or just indicates that the horizontal height of the first feature is lower than that of the second feature.

Embodiment 1

Figure 2:
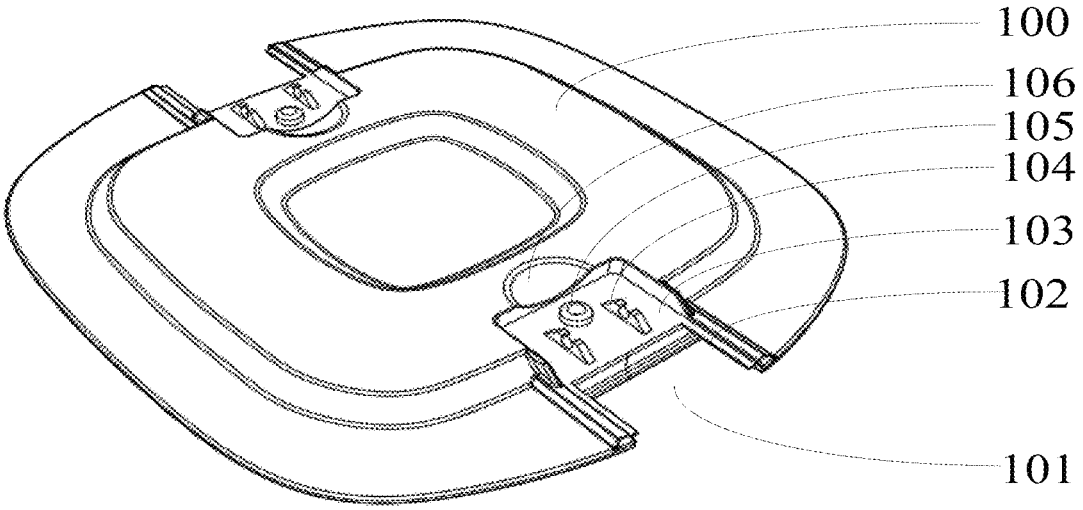
FIG. 2 is a structural schematic diagram of a glassware lid provided by the present invention.
Figure 8:
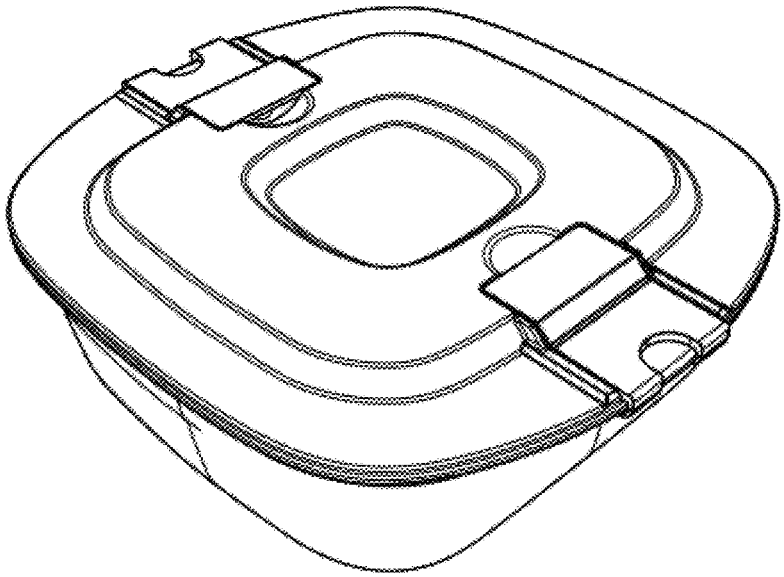
FIG. 8 shows an embodiment of a glassware provided by the present invention (square)

The present invention provides a glassware lid as shown in FIGS. 1-2 and 8, comprising a square lid body 100, wherein a through slot 101 is arranged at the edge of the lid body 100; both sides of the through slot 101 are respectively provided with two groups of first sliding parts 102; a platform 103 is formed in the through slot 101; and the platform 103 is provided with a first bracket 104 and a vent hole 105 in sequence from outside to inside;

a shaft rod 200, wherein the shaft rod 200 is hinged on the first bracket 104;

and an air hole sliding lid 300, wherein the bottom of one end of the air hole sliding lid 300 is hinged on both ends of the shaft rod 200, and a part of the air hole sliding lid 300 corresponding to the vent hole 105 can be turned to change a flow state or cutoff state of the vent hole 105 and an external airflow; both sides of the other end corresponding to the two groups of first sliding parts 102 are provided with two groups of second sliding parts 302, and the end part of the other end is provided with a hook 303 for clamping a glassware body 400.

The present invention discloses and provides a glassware lid. After food is heated, the lid body is covered; a first end of the air hole sliding lid is turned so that the air hole is communicated with outside atmosphere to avoid forming a vacuum state inside; when the lid needs to be taken out, the first sliding parts and the second sliding parts continue to slide to separate the hoop from the glassware body; and the glassware lid is easily taken out, which is convenient to operate. The hoop of the lid of the present invention is combined with the air hole lid, so that a product structure is compacter and arrangement is more reasonable.

Embodiment 2

Figure 9:
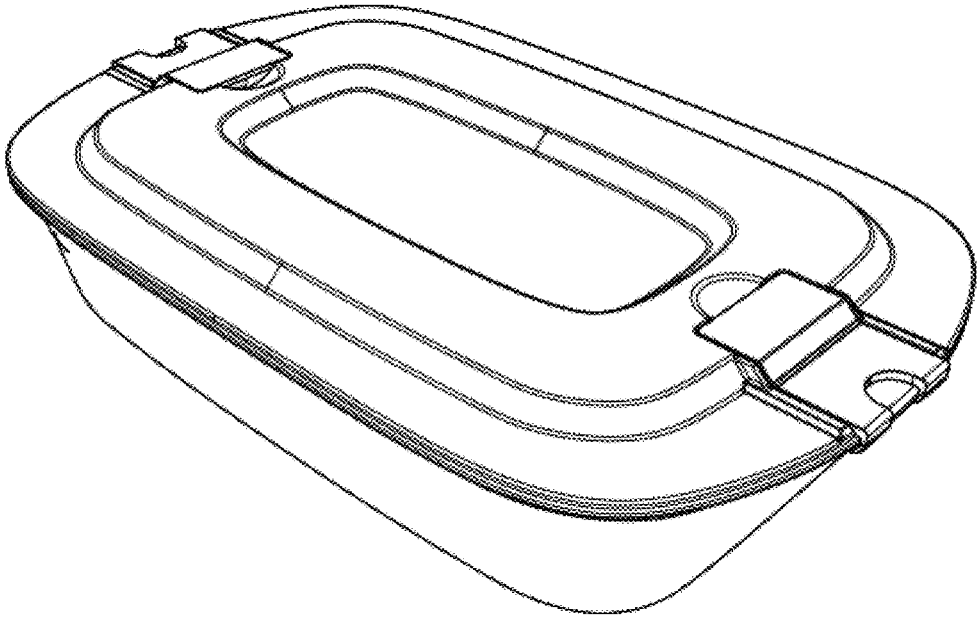
FIG. 9 shows an embodiment of a glassware provided by the present invention (rectangular)
Figure 10:
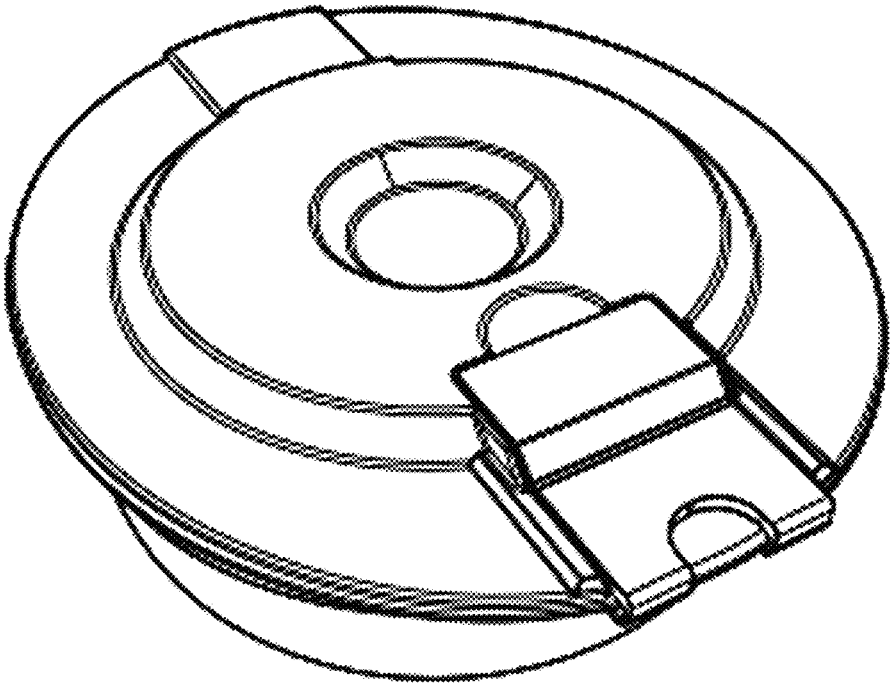
FIG. 10 shows an embodiment of a glassware provided by the present invention (circular).

The present invention provides a glassware lid as shown in FIGS. 1-2 and 9, comprising a rectangular lid body 100, wherein a through slot 101 is arranged at the edge of the lid body 100; both sides of the exterior of the through slot 101 are respectively provided with first sliding parts 102; a platform 103 is formed in the through slot 101; and the platform 103 is provided with a first bracket 104 and a vent hole 105 in sequence from outside to inside;

a shaft rod 200, wherein the shaft rod 200 is hinged on the first bracket 104;

and an air hole sliding lid 300, wherein the bottom of one end of the air hole sliding lid 300 is hinged on both ends of the shaft rod 200, and a part of the air hole sliding lid 300 corresponding to the vent hole 105 can be turned to change a flow state or cutoff state of the vent hole 105 and an external airflow; both sides of the other end corresponding to the first sliding parts 102 are provided with second sliding parts 302, and the end part of the other end is provided with a hook 303 for clamping a glassware body 400.

Embodiment 3

The present invention provides a glassware lid as shown in FIGS. 1-2 and 8, comprising a circular lid body 100, wherein a through slot 101 is arranged at the edge of the lid body 100; both sides of the exterior of the through slot 101 are respectively provided with first sliding parts 102; a platform 103 is formed in the through slot 101; and the platform 103 is provided with a first bracket 104 and a vent hole 105 in sequence from outside to inside;

a shaft rod 200, wherein the shaft rod 200 is hinged on the first bracket 104;

and an air hole sliding lid 300, wherein the bottom of one end of the air hole sliding lid 300 is hinged on both ends of the shaft rod 200, and a part of the air hole sliding lid 300 corresponding to the vent hole 105 can be turned to change a flow state or cutoff state of the vent hole 105 and an external airflow; both sides of the other end corresponding to the first sliding parts 102 are provided with second sliding parts 302, and the end part of the other end is provided with a hook 303 for clamping a glassware body 400.

Figure 3:
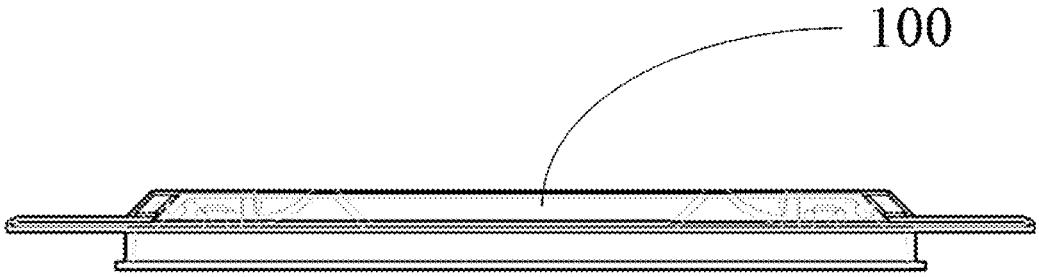
FIG. 3 is a side view of a glassware lid provided by the present invention.

Advantageously, in the above embodiments, as shown in FIG. 3, the lid body 100 comprises a top lid, a middle lid and a bottom lid which are connected in sequence; the area of the middle lid is larger than the area of the top lid and the area of the bottom lid, and the through slot 101 is arranged at the edge of the middle lid; a hemispherical recess 106 is formed on the top lid near the vent hole 105. This design can reduce the weight of the lid body, and at the same time, the bottom lid is matched with an inner wall of the glassware body for better sealing performance. The platform extends to the top lid, to provide an operating space for turning one end of the air hole sliding lid.

Figure 4:
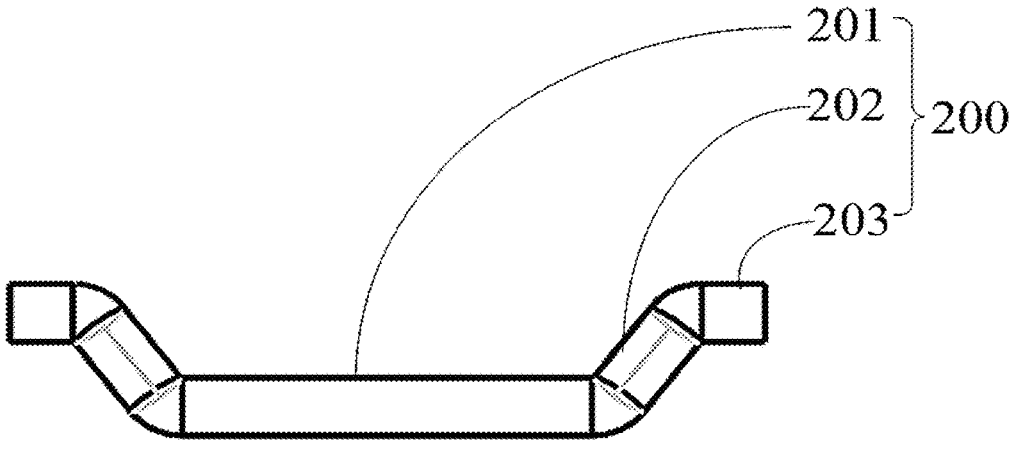
FIG. 4 is a structural schematic diagram of a shaft rod of a glassware lid provided by the present invention.

As shown in FIG. 4, the shaft rod 200 comprises a first straight rod section 201, a bending section 202 and a second straight rod section 203; both ends of the first straight rod section 201 are bent upward to form the bending section 202, and the bending section 202 is connected with the second straight rod section 203; the second straight rod section 203 is arranged in parallel to the first straight rod section 201, the first straight rod section 2W is hinged on the first bracket 104; and the bottom of one end of the air hole sliding lid 300 is hinged on the second straight rod section 203.

Figure 5:
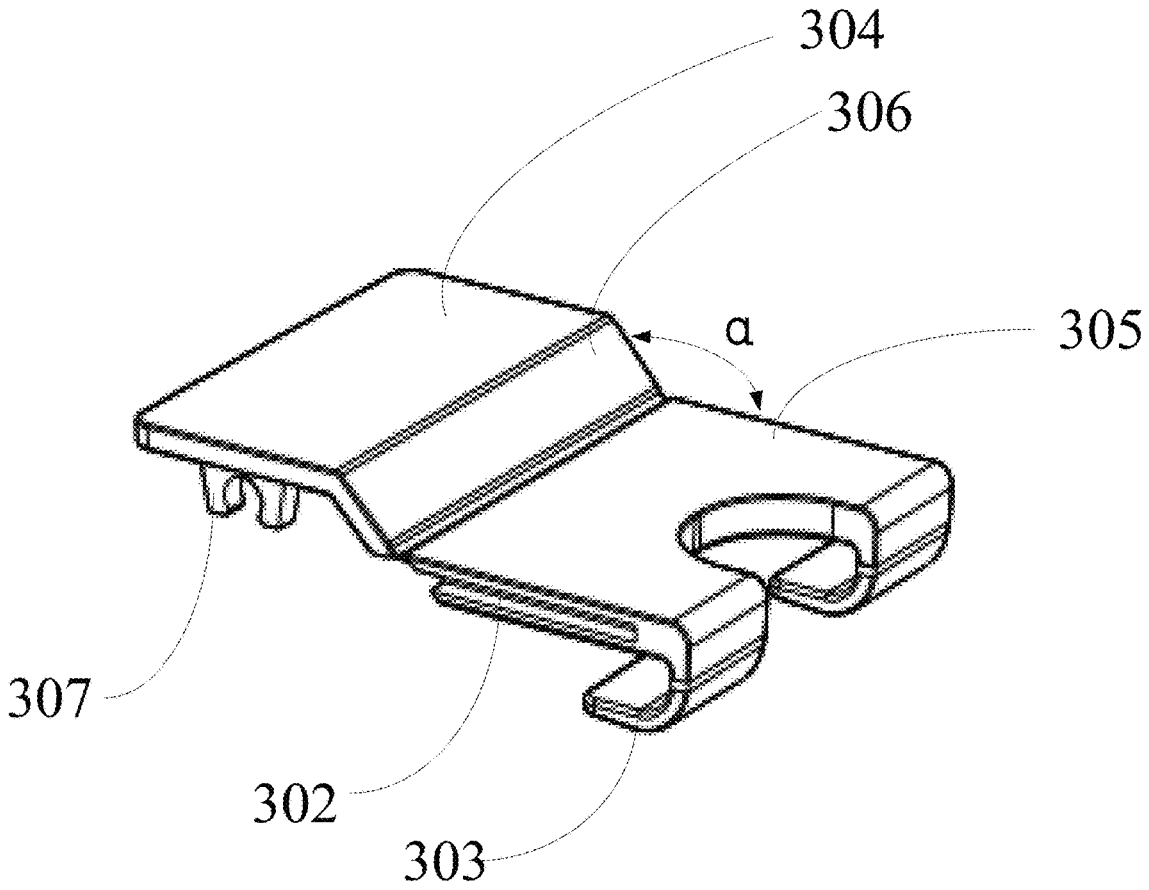
FIG. 5 is a stereogram of an air hole sliding lid of a glassware lid provided by the present invention.
Figure 6:
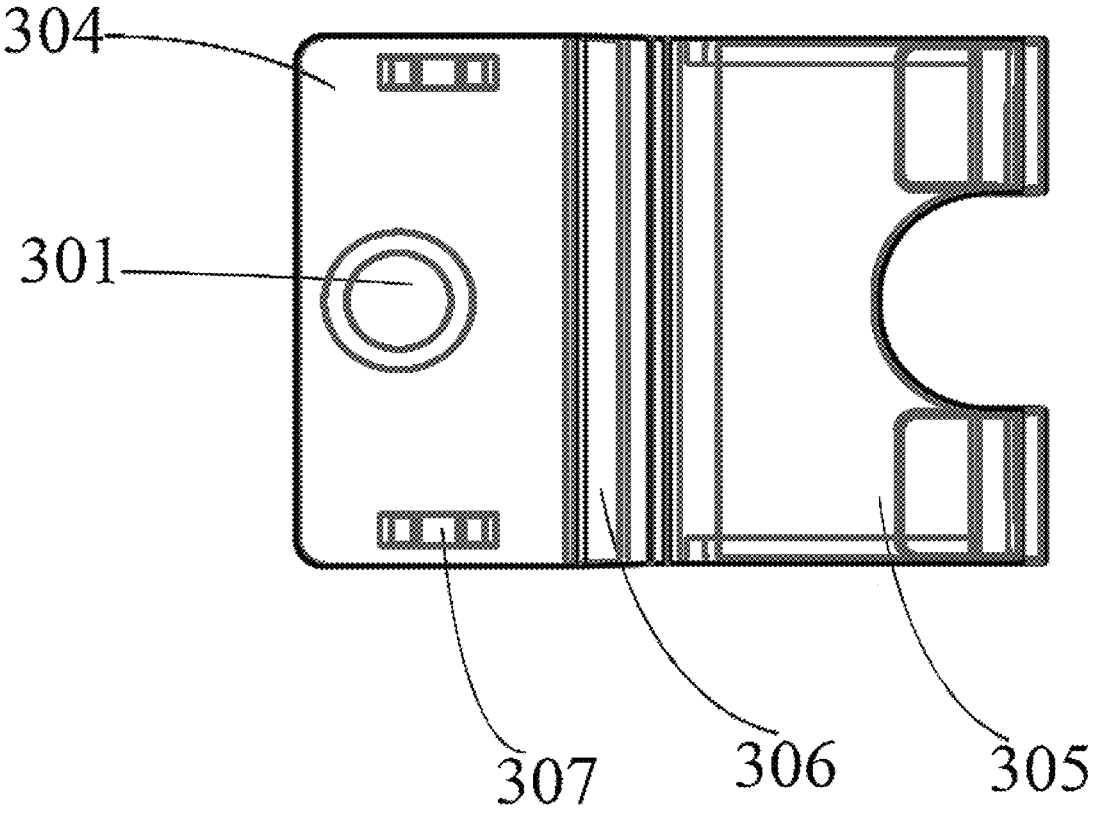
FIG. 6 is a top view of an air hole sliding lid of a glassware lid provided by the present invention.
Figure 7:
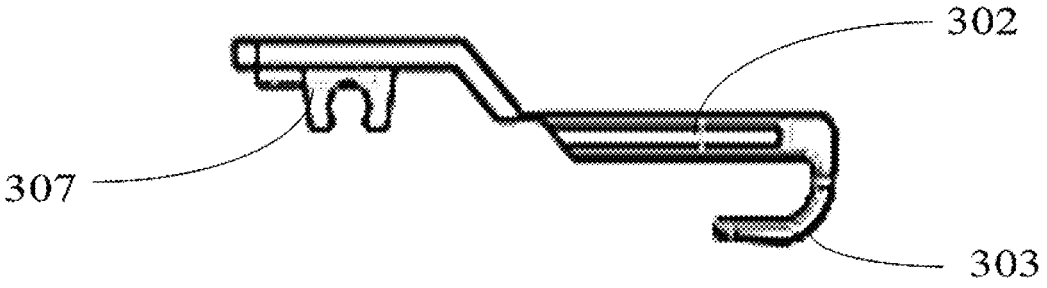
FIG. 7 is a side view of FIG. 6.

As shown in FIGS. 5-7, the air hole sliding lid 300 comprises a turning lid 304, a sliding lid 305 and a connecting plate 306; the bottom of the turning lid 304 is provided with a second bracket 307, and the second straight rod section 203 is hinged on the second bracket 307; two side surfaces of the sliding lid 305 are provided with the second sliding parts 302, and the end part is bent downward to form the hook 303; the connecting plate 306 is connected between the turning lid 304 and the sliding lid 305, and the plane of the connecting plate 306 and the plane of the sliding lid 305 form $\alpha$ angle; and the material hardness of a side near the sliding lid 305 is less than the material hardness value of the other side. Thus, the turning lid is conveniently turned.

A curved through slot is formed in the middle of the hoop of the sliding lid, which is convenient for finger operation to pushing out the hoop. Because an arc is formed at the edges of the lid body and the glassware body, this design is beneficial to reduce a connection error between the hook and the glassware body and reduce the problem of uneven contact points between the middle of the hook and the glassware body.

Specifically, the $\alpha$ angle is 120°-150°. The vent hole protrudes from the height of the platform and is higher than the height of the bracket, which is convenient for the turning lid to cover the vent hole. The angle setting is beneficial for connecting the connecting plate to the turning lid and the sliding lid which are not in the same plane.

Advantageously, the bottom of the turning lid 304 near the second bracket 307 is provided with a plug 301; and the plug 301 protrudes downward, and corresponds to the position of the vent hole 105. This is more beneficial to seal the interior of the glassware when not heating.

In the above embodiments, the first sliding parts 102 are sliding rails or chutes; and the second sliding parts 302 are chutes or sliding rails corresponding to the first sliding parts 102.

As shown in FIGS. 1 and 8-10, the present invention provides a glassware, comprising a glassware body 400, a sealing element 500 and the glassware lid of any one of claims 1-7; the glassware body 400 is provided with a connecting edge 401 corresponding to the position of the through slot 101; the hook 303 is clamped on the connecting edge 401; the first sliding parts 102 and the second sliding parts 302 are in sliding fit; the sealing element 500 is installed on the bottom of the lid body 100 for sealing a gap between the glassware body 400 and the lid body 100. The sealing element can be a sealing ring and is sleeved on the bottom lid.

In the normal state of the present invention, the vent hole is closed, and the turning lid and the sliding lid are in a parallel state. In use as required, the turning lid is turned at the hemispherical recess, and the turning lid drives the shaft rod to rotate so that the shaft rod is tilted upward, i.e., the turning lid is separated from the vent hole. The vent hole is communicated with the outside. Because the hoop and the connecting edge are matched and the first sliding parts and the second sliding parts are not matched, the seal between the lid body and the glassware body is not affected. When the lid body needs to be opened, the sliding lid is pushed outwards to enable the shaft rod to continue to rotate backwards; the first sliding parts and the second sliding parts slide relatively, until the hook and the connecting edge are separated, to take out a dish body. In this process, the reason that the first sliding parts and the second sliding parts are not separated is that the shaft rod is hinged with the second bracket, and the matching length of the first sliding parts and the second sliding parts is larger than the matching length of the hook and the connecting edge.

In the present invention, according to the sealing area on the lid body, more than two groups of air hole sliding lids can be arranged, and the materials and shapes of the lids are not limited as long as the needs of use ca be satisfied. Moreover, the above designs of the present invention shall be included within the protection scope of the present invention.

In the illustration of this description, the illustration of reference terms "one embodiment", "some embodiments", "example", "specific example" or "some examples", etc means that specific features, structures, materials or characteristics illustrated in combination with the embodiment or example are included in at least one embodiment or example of the present invention. In this description, exemplary statements for the above terms do not have to aim at the same embodiment or example. Moreover, the described specific features, structures, materials or characteristics can be combined appropriately in any one or more embodiments or examples. In addition, those skilled in the art can combine and integrate different embodiments or examples illustrated in this description.

Although the embodiments of the present invention have been shown and described above, it will be appreciated that the above embodiments are exemplary and shall not be understood as limitations to the present invention. Those ordinary skilled in the art can make changes, amendments, replacements and variations to the above embodiments within the scope of the present invention.

The invention claimed is:

1. A glassware lid, comprising:

a lid body (100), wherein a through slot (101) is arranged at the edge of the lid body (100); both sides of the through slot (101) are respectively provided with two groups of first sliding parts (102); a platform (103) is formed in the through slot (101); and the platform (103) is provided with a first bracket (104) and a vent hole (105) in sequence from outside to inside;

a shaft rod (200), wherein the shaft rod (200) is hinged on the first bracket (104);

and an air hole sliding lid (300), wherein the bottom of one end of the air hole sliding lid (300) is hinged on both ends of the shaft rod (200), and a part of the air hole sliding lid (300) corresponding to the vent hole (105) can be turned to change a flow state or cutoff state of the vent hole (105) and an external airflow; both sides of the other end corresponding to the two groups of first sliding parts (102) are provided with two groups of second sliding parts (302), and the end part of the other end is provided with a hook (303) for clamping a glassware body (400), wherein the shaft rod (200) comprises a first straight rod section (201), a bending section (202) and a second straight rod section (203); both ends of the first straight rod section (201) are bent upward to form the bending section (202), and the bending section (202) is connected with the second straight rod section (203); the second straight rod section (203) is arranged in parallel to the first straight rod section (201); the first straight rod section (201) is hinged on the first bracket (104); and the bottom of one end of the air hole sliding lid (300) is hinged on the second straight rod section (203).

2. The glassware lid according to claim 1, wherein the lid body (100) comprises a top lid, a middle lid and a bottom lid which are connected in sequence; the area of the middle lid is larger than the area of the top lid and the area of the bottom lid, and the through slot (101) is arranged at the edge of the middle lid; a hemispherical recess (106) is formed on the top lid near the vent hole (105).

3. The glassware lid according to claim 2, wherein the first sliding parts (102) are sliding rails or chutes; and the second sliding parts (302) are chutes or sliding rails corresponding to the first sliding parts (102).

4. The glassware lid according to claim 1, wherein the air hole sliding lid (300) comprises a turning lid (304), a sliding lid (305) and a connecting plate (306); the bottom of the turning lid (304) is provided with a second bracket (307), and the second straight rod section (203) is hinged on the second bracket (307); two side surfaces of the sliding lid (305) are provided with the second sliding parts (302), and the end part is bent downward to form the hook (303); the connecting plate (306) is connected between the turning lid (304) and the sliding lid (305), and the plane of the connecting plate (306) and the plane of the sliding lid (305) form $\alpha$ angle; and the material hardness of a side near the sliding lid (305) is less than the material hardness value of the other side.

5. The glassware lid according to claim 4, wherein the $\alpha$ angle is 120°-150°.

6. The glassware lid according to claim 4, wherein the bottom of the turning lid (304) near the second bracket (307) is provided with a plug (301); and the plug (301) protrudes downward, and corresponds to the position of the vent hole (105).

7. The glassware lid according to claim 6, wherein the first sliding parts (102) are sliding rails or chutes; and the second sliding parts (302) are chutes or sliding rails corresponding to the first sliding parts (102).

8. The glassware lid according to claim 5, wherein the first sliding parts (102) are sliding rails or chutes; and the second sliding parts (302) are chutes or sliding rails corresponding to the first sliding parts (102).

9. The glassware lid according to claim 4, wherein the first sliding parts (102) are sliding rails or chutes; and the second sliding parts (302) are chutes or sliding rails corresponding to the first sliding parts (102).

10. The glassware lid according to claim 1, wherein the first sliding parts (102) are sliding rails or chutes; and the second sliding parts (302) are chutes or sliding rails corresponding to the first sliding parts (102).

11. The glassware lid according to claim 1, wherein the first sliding parts (102) are sliding rails or chutes; and the second sliding parts (302) are chutes or sliding rails corresponding to the first sliding parts (102).

12. A glassware, comprising a glassware body (400), a sealing element (500) and the glassware lid of claim 1, wherein the glassware body (400) is provided with a connecting edge (401) corresponding to the position of the through slot (101); the hook (303) is clamped on the connecting edge (401); the first sliding parts (102) and the second sliding parts (302) are in sliding fit; the sealing element (500) is installed on the bottom of the lid body (100) for sealing a gap between the glassware body (400) and the lid body (100).

* * * * *